US005791230A

United States Patent [19]

Goellner

[11] Patent Number: 5,791,230

[45] Date of Patent: Aug. 11, 1998

[54] ROD CLAMPING DEVICE FOR A LINEAR FLUID ACTUATOR

[75] Inventor: Willy J. Goellner, Rockford, Ill.

[73] Assignee: Advanced Machine & Engineering Co., Rockford, Ill.

[21] Appl. No.: 837,489

[22] Filed: Apr. 18, 1997

[51] Int. Cl.[6] ..... F15B 15/26

[52] U.S. Cl. ..... 92/19; 92/18; 92/24; 92/28

[58] Field of Search ..... 92/18, 19, 24, 92/26, 27, 28; 91/44

[56] References Cited

U.S. PATENT DOCUMENTS

| | | | |
|---|---|---|---|
| 2,632,425 | 3/1953 | Grover | 92/27 |
| 3,208,759 | 9/1965 | Firestone et al. | 92/27 |
| 3,320,861 | 5/1967 | Johnson et al. | 91/44 |
| 3,429,233 | 2/1969 | Wright | 92/19 |
| 3,575,087 | 4/1971 | Sherwood | 92/28 |
| 3,615,100 | 10/1971 | Banner . | |
| 3,643,765 | 2/1972 | Hanchen | 92/26 |
| 3,941,141 | 3/1976 | Robert | 92/18 |
| 4,537,113 | 8/1985 | Stoll . | |
| 4,577,732 | 3/1986 | Gottling | 92/27 |
| 4,890,541 | 1/1990 | Spooner . | |
| 5,137,400 | 8/1992 | Sagara . | |
| 5,540,135 | 7/1996 | Goellner . | |

*Primary Examiner*—Thomas E. Denion
*Attorney, Agent, or Firm*—Vernon J. Pillote

[57] ABSTRACT

A rod clamp device having a clamp sleeve and a cam member spring biased axially in a direction to actuate the clamp sleeve to a clamp condition, and a clamp release piston that is operable through a mechanical force amplifying mechanism to move the cam member in opposition to the spring to release the clamp sleeve. The clamp release piston is operated in response to fluid pressure to produce a force correlative with the fluid pressure and the clamp release piston moves an annular ramp to force a plurality of ball elements between a thrust surface on an end of the cam ring and a stationary thrust surface and move the can ring axially in a direction to recompress the spring.

14 Claims, 2 Drawing Sheets

FIG. 1
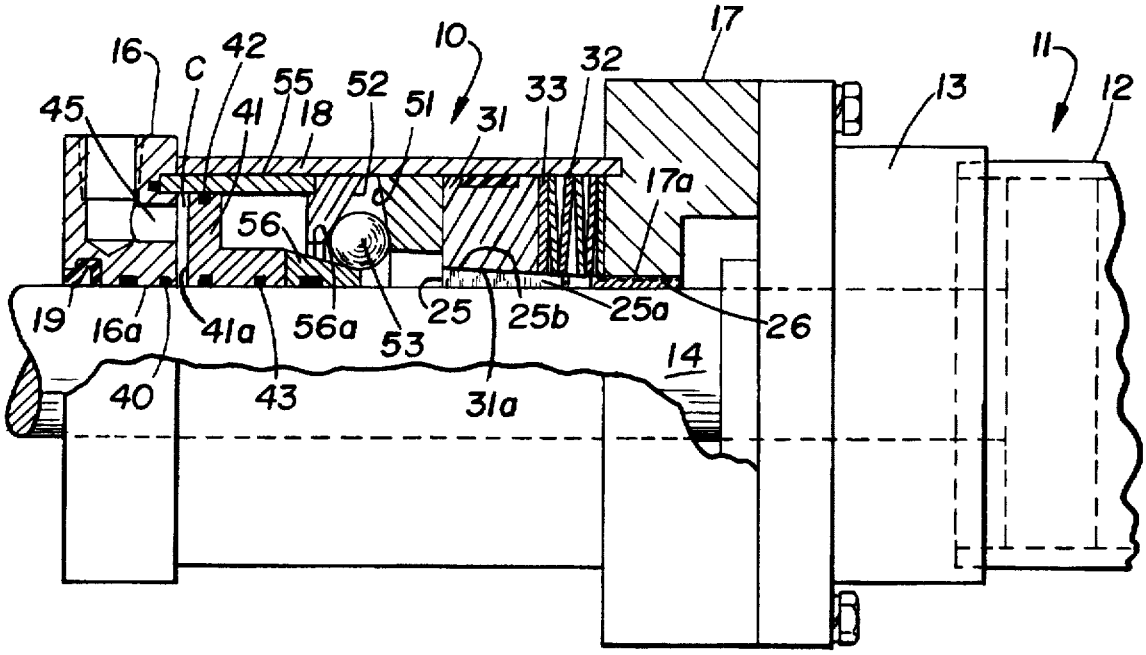
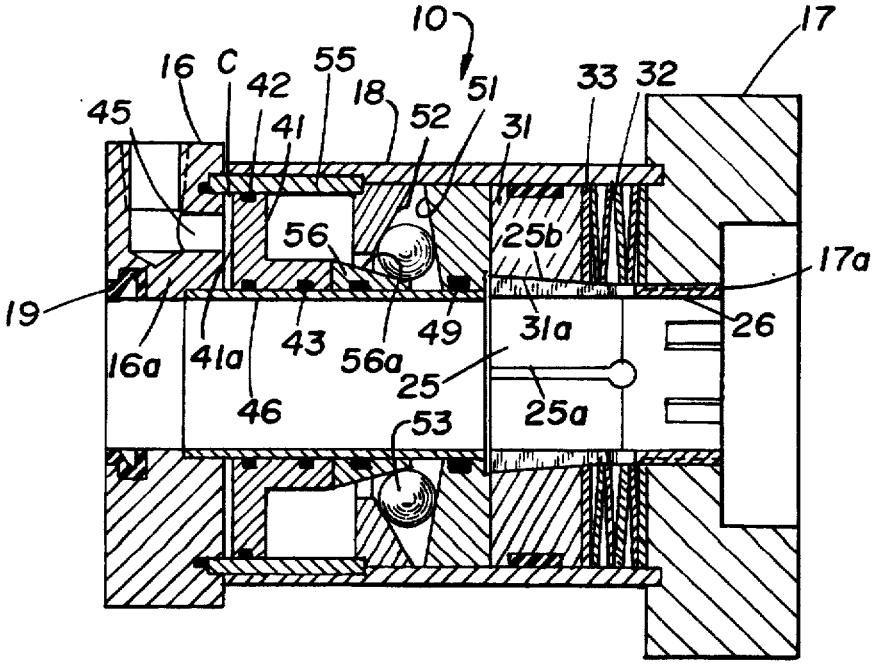
FIG. 2

FIG. 3
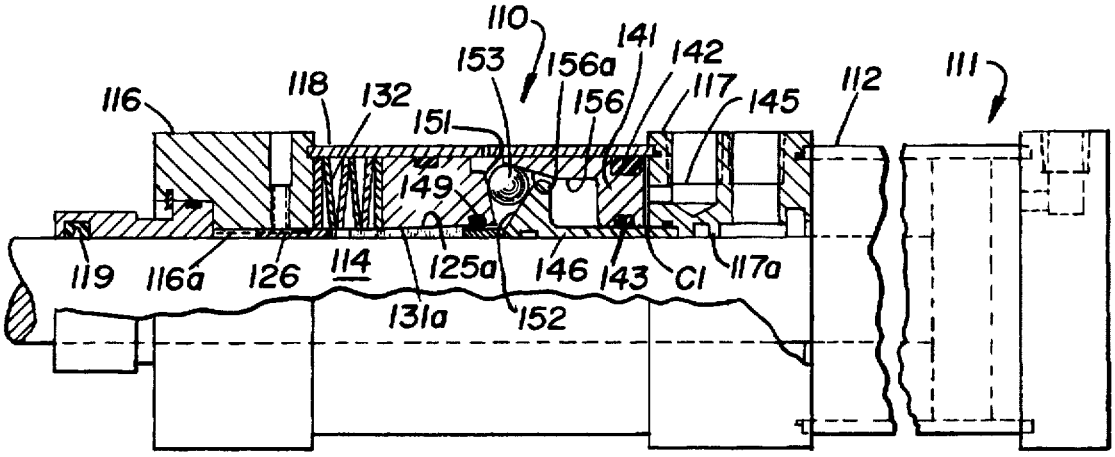
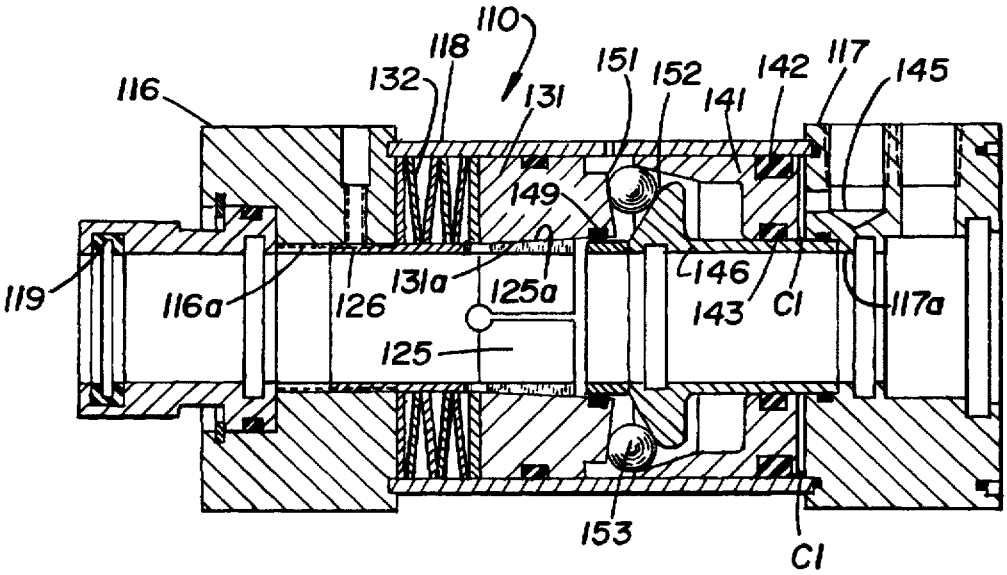
FIG. 4

ROD CLAMPING DEVICE FOR A LINEAR FLUID ACTUATOR

BACKGROUND OF THE INVENTION

The present invention relates to devices clamping the piston rod of a linear fluid actuator against axial movement, to hold the rod in the position to which it has been moved by the linear actuator when pressure to the actuator is shut off, or in the event of failure of the pressure supply to the linear actuator. Such devices are commonly spring-actuated to a clamp condition. However, difficulties have been encountered in making a rod clamp having a brake housing with a crosssectional size corresponding to that of the associated linear fluid actuator, and which can provide adequate rod clamping action to hold the rod against movement under the loads encountered by the linear fluid actuator, and which can also provide reliable release of the rod clamp at low operating pressures, particularly in rod clamps for small size linear actuators.

Some rod clamp devices for linear fluid actuators use a single piston to directly actuate the clamp device to a release condition and others such as disclosed in U.S. Pat. Nos. 5,137,400 and 5,540,135, use multiple fluid operated pistons to effect release of the clamp device. U.S. Pat. No. 4,537,113 discloses a rod clamp device for a linear fluid actuator in which a collet is actuated by a cam ring and an axially expansible spring operates through a cam and ball type force intensifying mechanism to increase the axial force on the cam ring and thereby enhance the clamping action of the collet. A fluid pressure operated piston is provided for recompressing the spring to release the clamp device. However, compressing the spring may not be sufficient to effect movement of the cam ring in a direction to release the collet, due to of the low taper of the collet and the static friction between the mating surfaces of the collet and cam ring.

SUMMARY OF THE INVENTION

It is the general object of the present invention to provide a clamp device for the piston rod of a linear fluid actuator, which is actuated by springs to provide a high clamping force for holding the rod against axial movement, and which mechanically amplifies the force of a fluid pressure operated clamp release piston, to effect reliable release of the clamp device.

Another object of the present invention is to provide a clamp device for the piston rod of a linear fluid actuator, which can provide both high rod clamping force and reliable rod release, in a brake housing having a cross-sectional size generally corresponding to that of the linear fluid actuator.

The present invention accomplishes the above objects, among others, by providing a rod clamp device having a clamp sleeve and a cam member spring biased axially in a direction to actuate the clamp sleeve to a clamp condition, and a clamp release piston that is operable through a mechanical force amplifying mechanism to move the cam member in opposition to the spring to release the clamp sleeve. The clamp release piston is operated in response to fluid pressure applied thereto to produce a force correlative with the fluid pressure and the clamp release piston moves an annular ramp to force a plurality of ball elements between a thrust surface on an end of the cam ring and a stationary thrust surface and move the cam ring axially in a direction opposite the direction of its movement by the spring.

BRIEF DESCRIPTION OF THE DRAWINGS

FIG. 1 is a fragmentary longitudinal sectional view through one embodiment of the rod clamp device shown applied to a linear fluid actuator;

FIG. 2 is longitudinal sectional view through a second embodiment of the rod clamp device;

FIG. 3 is a fragmentary longitudinal sectional view through a third embodiment of the braking device shown in integrated with a linear fluid actuator; and FIG. 4 is a longitudinal sectional view through the rod clamp device of FIG. 3, on a larger scale than Fig. 3.

DETAILED DESCRIPTION

The present invention relates to a rod clamp device 10 for a linear fluid actuator 11 for holding the piston rod in a position to which it has been moved by the fluid actuator. As is conventional, the linear fluid actuator 11 includes an actuator cylinder 12 having a cylinder head 13 and a piston rod 14 extending through the cylinder head. The linear fluid actuator 11 can be of the single or double acting type, and the size of the fluid actuator is selected such that the available operating fluid pressure acting on the piston area is sufficient to move the piston rod under the loads to be moved by the actuator. The rod clamp device 10 is provided to clamp and hold the piston rod in the position to which it is adjusted by the fluid actuator and prevent movement of the piston rod by the load, when the fluid power to the actuator is shut off or in the event of a failure of the source of the fluid power. The clamp device includes a housing having first and second end walls 16 and 17, and an outer casing 18 extending between the end walls. The end wall 17 is shown in FIGS. 1 and 2, attached to the cylinder head, but it may be formed integrally with the cylinder head as described hereinafter. The end walls 16 and 17 have openings **16*a* and 17*a* to allow passage of the piston rod 14 through the housing. A resilient wiper ring 19 is provided on the end wall 16 to inhibit entrance of foreign matter into the rod clamp device during the retraction of the piston rod. A rod clamp sleeve 25 is disposed around the piston rod and the clamp sleeve is radially contractible into engagement with the piston rod. In the embodiments illustrated, the clamp sleeve has lengthwise extending slots 25*a* that facilitate radial expansion and contraction of the clamp sleeve. The clamp sleeve is fixed against axial movement relative to the housing and is preferably formed with an end portion 26 that is threadedly mounted in the opening 17*a* in the end wall 17, to enable axial adjustment of the clamp sleeve relative to the end wall. The clamp sleeve 25 has a tapered outer surface 25*b* and an annular cam member or cam ring 31 extends around the clamp sleeve and has a tapered inner surface 31*a* complementary to the outer surface of the clamp sleeve. The cam member is yieldably urged by springs 32, herein shown as disk springs, in a direction to actuate the clamp ring into clamping engagement with the rod. A retainer disk 33 is disposed at one end of the cam ring 31 and the springs 32 are interposed between the retainer disk and the second end wall 17 of the clamp housing. The springs 32 are selected to apply an axial force to the cam ring 31 sufficient to cam the clamp sleeve 25** into engagement with the piston rod and hold the piston rod against axial movement under outside forces imposed on the piston rod.

The rod clamp is arranged to be actuated by fluid pressure to a released condition. It is desirable that the clamp device and the cross-sectional size generally corresponding to the cross-sectional size of the linear fluid actuator and this limits the cross-sectional area available for an operating piston in the rod clamp device to a value substantially less than the cross-sectional area of the working end of the piston in the fluid actuator.

An annular clamp release piston 41 is disposed in the housing and has a piston face **41*a* facing the end wall 16 of the housing. A fluid pressure chamber C is provided in the housing between the piston face and the end wall 16. In the embodiment of FIG. 1, a seal 40 forms a slidable seal between the end wall 16 and the piston rod, and a seal 42 forms a slidable seal between the piston and the outer casing, and one or more seals 43 form a slidable seal between the piston 41 and the piston rod. A passage 45 is provided in the end wall 16 for passing pressurized fluid to the fluid pressure chamber C under the control of a valve (not shown), which may be the same valve used to control the linear fluid actuator. The clamp release piston 41 is movable in a forward direction away from the end wall 16 in response to fluid pressure on the piston face 41***a* of the piston rod. The springs 32 are selected to apply sufficient axial force to the cam ring, to reliably actuate the clamp ring into clamping engagement with the piston rod. However, the force that can be produced by the clamp release piston 41 is limited by the annular area of the face 41*a* of the clamp release piston and the fluid pressure.available for actuating the piston. In order to effect reliable release of the rod clamp device, the clamp release piston is arranged to operate through a mechanical force amplifying mechanism to move the cam member 31 in opposition to the springs 32, to release the clamp sleeve 25. For this purpose, a first thrust surface 51 is provided on an end of the cam ring 31 remote from the end of the cam ring that is engaged by the springs 32, and a second thrust surface 52 is fixed to the housing. The first and second thrust surfaces converge relative to each other and a plurality of ball elements 53 are disposed between and engage the relatively converging first and second thrust surfaces. An annular ramp 56 extends from the clamp release piston 41 in a direction away from the end wall 16 and the ramp has an annular ramp surface 56*a* for forcing the ball elements 53 between the relatively converging first and second thrust surfaces in response to movement of the clamp release piston in the forward direction, to thereby move the annular cam ring axially in a direction opposite the direction of movement by the springs and release the clamp sleeve.

Thus, the piston operates through the ramp and ball force multiplying device to directly move the cam ring to not only recompress the actuating springs 32, but also overcome the static friction between the cam ring and the clamp ring. In the embodiment of FIGS. 1 and 2, the cam ring 31 is preferably formed of a material such as bronze to reduce friction with the clamp sleeve and the thrust surface 51 is formed on a ring of wear resistant material that abuts an end of the clamp ring. It is contemplated that the thrust surface 51 could be formed integrally with the cam ring 31 if desired. Thrust surface 52 is fixed against axial movement relative to the housing. In the embodiment of FIGS. 1 and 2, the thrust surface 52 is formed on a ring of wear resistant material and the outer casing includes a sleeve 55 that extends between the thrust ring and the end wall 16 of the housing to fix the thrust surface against axial movement relative to the housing.

The embodiment of FIG. 2 is substantially the same as FIG. 1 and like numerals are used to designate the same parts. In this embodiment, an inner casing 46 is fixed to the end wall 16 and the piston 41 has seal rings 43 that form a slidable seal with the inner casing. The thrust surface 51 moves with the cam ring 31, and a seal ring 49 provides a slidable seal with the inner casing to inhibit lubricant that may be provided on the balls and thrust surfaces from reaching the piston rod of the fluid actuator. In the embodiments of FIGS. 1 and 2, the thrust surfaces 51 and 52 converge outwardly toward the outer casing 18 and the ramp surface 56*a* forces the balls 53 outwardly.

In the embodiment of FIGS. 3 and 4, like numerals in the hundred series are used to designate parts corresponding to those in FIGS. 1 and 2. In this embodiment the housing 110 of the clamp device includes first and second end walls 116 and 117, an outer casing 118 extending between the end walls, and an inner casing 146 fixed to the end wall 117. End wall 117 is herein shown formed in one piece with an end for the cylinder 112 of fluid actuator 111, it being understood that end wall 117 could be formed separate from the end of the fluid actuator and detachably secured thereto. End walls 116 and 117 have openings 116*a* and 117*a* for passage of the piston rod 114 therethrough and a wiper ring 119 is provided on the end wall 116 to inhibit entrance of foreign material. A clamp sleeve 125 is fixed against axial movement relative to the housing and is preferably provided with an end portion 126 that is threaded into the end wall 116 to facilitate axial adjustment of the clamp ring. The clamp ring 125 has an outer surface 125*a* that tapers outwardly in a direction away from the end wall 116 and a cam ring 131 is disposed in the housing and has an inner surface 131*a* that is tapered complementary to the outer surface of the clamp ring. Disk springs 132 are interposed between end wall 116 and one end of the cam ring 131 and are selected to apply an axial force to the cam ring sufficient to cam actuate the clamp sleeve 125 into clamping engagement with the piston rod and hold the piston rod against axial movement under outside forces imposed on the piston rod. A clamp release piston 141 is disposed between the inner and outer casings 145 and 118 and has seals 143 and 142 providing slidable seals between the piston and the inner and outer casings. A passage 145 is provided in the end wall 117 to supply fluid pressure to a chamber Cl between the end wall 117 and the clamp release piston 141.

The clamp release piston is arranged to operate through a mechanical force amplifying mechanism to effect release of if the clamp device. In this embodiment, a thrust surface 151 is provided on an end of the cam ring 131 opposite the end that is engaged by the springs 132 and a second thrust surface 152 is provided on an end of the inner casing 146 and fixed thereby against axial movement relative to the housing. The thrust surfaces 151 and 152 converge in a direction inwardly toward the shaft 114 and ball elements 153 are disposed between the relatively converging thrust surfaces 151 and 152. A ramp means 156 extends from the clamp release piston 141 in a direction away from the end wall 117 and the ramp has an annular ramp surface 156*a* that engages the balls 153. The ramp surface forces the balls inwardly between the relatively converging thrust surfaces in response to movement of the clamp release piston in a forward direction to thereby move the annular cam ring axially in a direction opposite the direction of movement by springs 132 and release the clamp sleeve. In order to inhibit passage of lubricant that may be provided on the thrust surfaces and or balls, a seal ring 149 is provided to slidably seal the interface between the cam ring and the inner casing.

From the forgoing it is believed that the construction and operation of the rod clamp device will be readily understood. The springs apply an axial force to the cam ring sufficient to cam actuate the clamp sleeve into engagement with the piston rod and normally hold the rod against axial movement under outside forces imposed on the piston rod. The clamp device is actuated by fluid pressure applied to the clamp release piston and the thrust of the clamp release piston is transmitted through the ramp that forces the balls between the relatively converging thrust surfaces, to move the cam ring in opposition to the spring to release the clamp ring.

The embodiments of the invention in which an exclusive property or privilege is claimed are defined as follows:

1. A piston rod clamp device for a linear fluid actuator comprising; a housing including an outer casing and spaced end walls, the end walls having axially aligned openings therethrough, a linear fluid actuator having a piston rod extending through the openings in the end walls, a clamp sleeve in the housing fixed to one of the end walls and having an outer surface that tapers inwardly in a direction toward said one end wall, a cam ring slidable in the outer casing and having opposite ends and a tapered inner surface engaging the outer surface of the clamp sleeve, spring means between said one end wall and an adjacent end of the annular cam ring yieldably urging said cam ring in a first direction away from said one end wall to actuate the clamp sleeve to a clamp condition, a first thrust surface on an end of the cam ring remote from said one end of the cam ring, a second thrust surface opposed to said first thrust surface and fixed to the housing, the first and second thrust surfaces converging relative to each other, a plurality of ball elements between and engaging the converging first and second thrust surfaces, an annular clamp release piston in the housing having a piston face facing the other of the end walls, means providing a fluid pressure chamber in the housing between said piston face and said other end wall, passage means for passing pressurized fluid to said fluid pressure chamber, said clamp release piston being movable in a forward direction away from said other end wall in response to fluid pressure on the piston face of said piston, ramp means extending from the clamp release piston in said forward direction away from said other end wall and having an annular ramp surface for forcing said plurality of ball elements between the relatively converging first and second thrust surfaces in response to movement of the clamp release piston in said forward direction to thereby move the annular cam ring axially in a direction opposite said first direction and release the clamp sleeve.

2. A device according to claim 1 wherein said means providing a fluid pressure chamber includes means forming a slidable seal between said other end wall and the piston rod, and means forming a slidable seal between the annular clamp release piston and the piston rod.

3. A device according to claim 1 wherein said means providing a fluid pressure chamber includes an inner casing fixed to said other end wall and slidably receiving the piston rod, means forming a slidable seal between the annular clamp release piston and the outer casing and means forming a slidable seal between the annular clamp release piston and the inner casing.

4. A device according to claim 1 wherein said first and second thrust surfaces converge in a direction toward the outer casing.

5. A device according to claim 1 wherein said first and second thrust surfaces converge in a direction toward the piston rod.

6. A rod clamp device for a linear fluid actuator comprising; a brake housing including an outer casing and end walls and an inner casing fixed to one of the end walls, the end walls having axially aligned openings for passage of a piston rod therethrough, a clamp sleeve in the housing fixed to the other of the end walls and having an outer surface that tapers inwardly in a direction toward said other end wall, a cam ring slidable in the outer casing and having opposite ends and a tapered inner surface engaging the outer surface of the clamp sleeve, spring means between said other end wall and an adjacent end of the annular cam ring yieldably urging said cam ring in a first direction away from said other end wall to actuate the clamp sleeve to a clamp condition, a first thrust surface on an end of the cam ring remote from said one end of the cam ring, a second thrust surface opposed to said first thrust surface and fixed to said housing, the first and second thrust surfaces converging relative to each other in a direction toward said outer casing, a plurality of ball elements between and engaging the converging first and second thrust surfaces, an annular clamp release piston in the housing having a sliding seal with the inner and outer casings and a piston face facing said other end wall and providing a fluid pressure chamber in the housing between said piston face and said other end wall, passage means for passing pressurized fluid to said fluid pressure chamber, said clamp release piston being responsive to fluid pressure on said piston face to move in a forward direction away from said other end wall, ramp means extending from the clamp release piston in a direction away from said other end wall and having an annular ramp surface for forcing said plurality of ball elements outwardly between the converging first and second thrust surfaces in response to movement of the clamp release piston in said forward direction and thereby move the annular cam ring axially in a direction opposite said first direction to release the clamp sleeve.

7. A device according to claim 6 including means providing a slidable seal between the cam ring and the inner casing.

8. A rod clamp device for a linear fluid actuator comprising; a housing including an outer casing and end walls and an inner casing fixed to one of the end walls, said end walls having axially aligned openings for passage of a piston rod therethrough, a clamp sleeve in the housing fixed to the other of the end walls and having an outer surface that tapers inwardly in a direction toward said other end wall, a cam ring slidable in the outer casing and having opposite ends and tapered inner surface engaging the outer surface of the clamp sleeve, spring means between said other end wall and an adjacent end of the annular cam ring yieldably urging said cam ring in a first direction away from said other end wall to actuate the clamp sleeve to a clamp condition, a first thrust surface on an end of the cam ring remote from said one end of the cam ring, a second thrust surface opposed to said first thrust surface and fixed to the inner casing, the first and second thrust surfaces converging relative to each other in a direction away from the outer casing, a plurality of ball elements between and engaging the converging first and second thrust surfaces, an annular clamp release piston in the housing having a sliding seal with the outer casing and the inner casing and a piston face facing said one end wall and providing a fluid pressure chamber in the housing between said piston face and said one end wall, passage means for passing pressurized fluid to said fluid pressure chamber, said clamp release piston being responsive to fluid pressure on the piston face to move in a forward direction away from said one end wall, ramp means extending from the clamp release piston in a direction away from said one end wall and having an annular ramp surface for forcing said plurality of ball elements inwardly between the relatively converging first and second thrust surfaces in response to movement of the clamp release piston in said forward direction to thereby move the annular cam ring axially in a direction opposite said first direction to release the clamp sleeve.

9. A device according to claim 8 including means providing a slidable seal between the cam ring and the inner casing.

10. A piston rod clamp device for a linear fluid actuator comprising: a housing including an outer casing and first and second walls, the first and second walls having openings aligned along an axis for passage of a piston rod through the housing, a clamp sleeve in the housing fixed to the first end wall and having an outer surface that tapers inwardly in a direction toward said first end wall, an annular cam ring movable along said axis and having a tapered inner surface engaging the outer surface of the clamp sleeve, spring means between said first end wall and the cam ring for yieldably urging said cam ring in a first direction along said axis to actuate the clamp sleeve to a clamp condition, means providing a first thrust surface on an end of the annular cam ring remote from said first end wall, means providing a second thrust surface opposed to said first thrust surface and stationary relative to said housing, the first and second thrust surfaces converging relative to each other in a direction cross-wise of said axis, a plurality of ball elements between and engaging the converging first and second thrust surfaces, an annular clamp release piston in the housing having a piston face opposed to said second end wall, and means providing a fluid pressure chamber in the housing between said piston face and said second end wall, passage means for passing pressurized fluid to said fluid pressure chamber, said clamp release piston being movable in response to fluid pressure on said piston face in a forward direction along said axis, ramp means extending in said forward direction from the clamp release piston ,said ramp means having an annular ramp surface for forcing said plurality of ball elements between the converging first and second thrust surfaces in response to movement of the clamp release piston in said forward direction to move the annular cam ring axially in a direction opposite said first direction and release the clamp sleeve.

11. A device according to claim 10, wherein said first and second thrust surfaces converge relative to each other in a direction toward the outer casing.

12. A device according to claim 10 wherein said first and second thrust surfaces converge relative to each other in a direction toward the inner casing.

13. A device according to claim 10 wherein said means providing a fluid pressure chamber included means for forming a slidable seal between said second end wall and a piston rod, and means for forming a slidable seal between the annular clamp release piston and a piston rod.

14. A device according to claim 10 wherein said means providing a fluid pressure chamber includes an inner casing fixed to said second end wall and surrounding the piston rod, means forming a slidable seal between the annular clamp release piston and the outer casing, and means forming a slidable seal between the annular clamp release piston and the inner casing.

* * * * *